US005947792A

United States Patent [19]

Wong

[11] Patent Number: 5,947,792

[45] Date of Patent: Sep. 7, 1999

[54] RESILIENT, WALKING TOY

[75] Inventor: Tak-Ko Wong, Hong Kong, The Hong Kong Special Administrative Region of the People's Republic of China

[73] Assignee: T. K. Wong & Associates, Ltd., The Hong Kong Special Administrative Region of the People's Republic of China

[21] Appl. No.: 09/033,369

[22] Filed: Mar. 2, 1998

[30] Foreign Application Priority Data

Apr. 2, 1997 [GB] United Kingdom ..... 9706672

[51] Int. Cl.[6] ..... A63H 11/08; A63H 3/18; A63H 17/00

[52] U.S. Cl. ..... 446/324; 446/323; 446/431

[58] Field of Search ..... 446/324, 314, 446/315, 320, 322, 323, 359, 361, 362, 363, 390, 374, 431

[56] References Cited

U.S. PATENT DOCUMENTS

| | | | |
|---|---|---|---|
| 545,958 | 9/1895 | Hoffmann | 446/315 |
| 2,219,130 | 10/1940 | Herrmann | 446/374 X |
| 2,647,342 | 8/1953 | Patterson | 446/361 |
| 4,227,335 | 10/1980 | Kuna et al. | 446/146 |
| 4,245,486 | 1/1981 | Matsumoto et al. | 446/314 X |
| 4,884,989 | 12/1989 | Wong | 446/431 X |
| 5,391,104 | 2/1995 | George | 446/315 X |
| 5,836,801 | 11/1998 | Lin | 446/315 |

FOREIGN PATENT DOCUMENTS

| | | |
|---|---|---|
| 2222958 | 3/1990 | United Kingdom . |
| 2307870 | 6/1997 | United Kingdom . |

*Primary Examiner*—D Neal Muir
*Attorney, Agent, or Firm*—Miller, Sisson, Chapman & Nash, P.C.

[57] ABSTRACT

A humanoid toy figure having a body with a sticky region at the end of each limb that temporarily adhere to vertical surfaces and cause the body to tumble down the surface in a manner already well-known. The sticky region is connected to the body by a resilient tie that allows or causes the body to drop vertically due to the weight of the body stretching the tie . If there is no weight on the tie , the sticky region will be held against a remote end of the respective arm.

3 Claims, 2 Drawing Sheets

RESILIENT, WALKING TOY

BACKGROUND OF THE INVENTION

1. Field of the Invention

The invention relates to a toy.

2. Description of Prior Art

The invention relates to a toy which under the influence of gravity will travel down a substantially vertical surface and is provided with sticky material at extremities of its limbs, such a toy is claimed and described in U.K. Patent 2222958 and in co-pending U.K.patent application No. 9704480.4.

SUMMARY OF THE INVENTION

According to the invention there is provided a toy which under the influence of gravity will travel down a substantially vertical surface, said toy comprising a body, appendages connected to various parts of the body, and a region of sticky material at each appendage, the adhesivity of the material being selected so that said regions of sticky material will adhere to the surface when they first contact the surface and then under the influence of gravity acting on the toy the upper of said regions or region will become detached from the surface so as to free said toy to rotate or tumble about its body to move successively down the surface, in which at least one of the regions of sticky material is attached to the body by a resilient tie that extends whenever the weight of the toy is supported by that region of sticky material.

The tie preferably has an end connected to a central part inside a cavity in the body.

BRIEF DESCRIPTION OF THE DRAWINGS

Toys according to the invention will now be described by way of example with reference to the accompanying schematic drawings in which.

DESCRIPTION OF THE PREFERRED EMBODIMENT

Figure 1A:
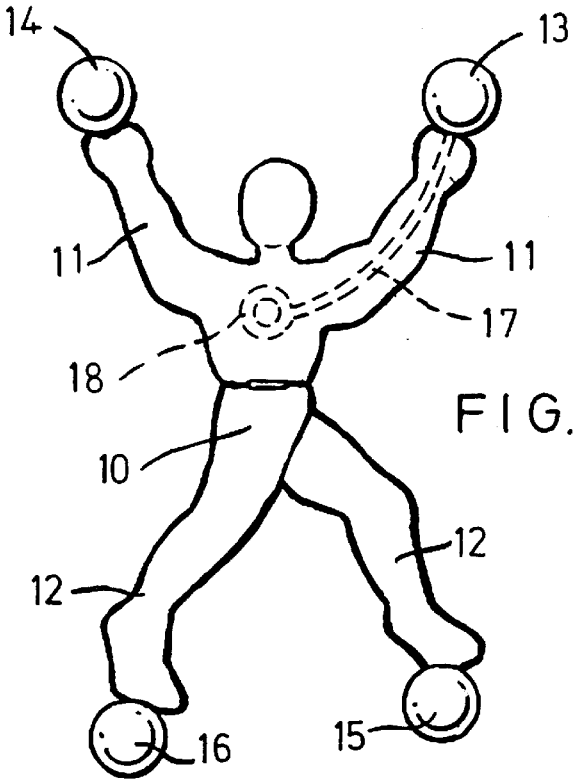
FIGS. 1A and 1B show two different configurations of a humanoid toy figure.
Figure 1B:
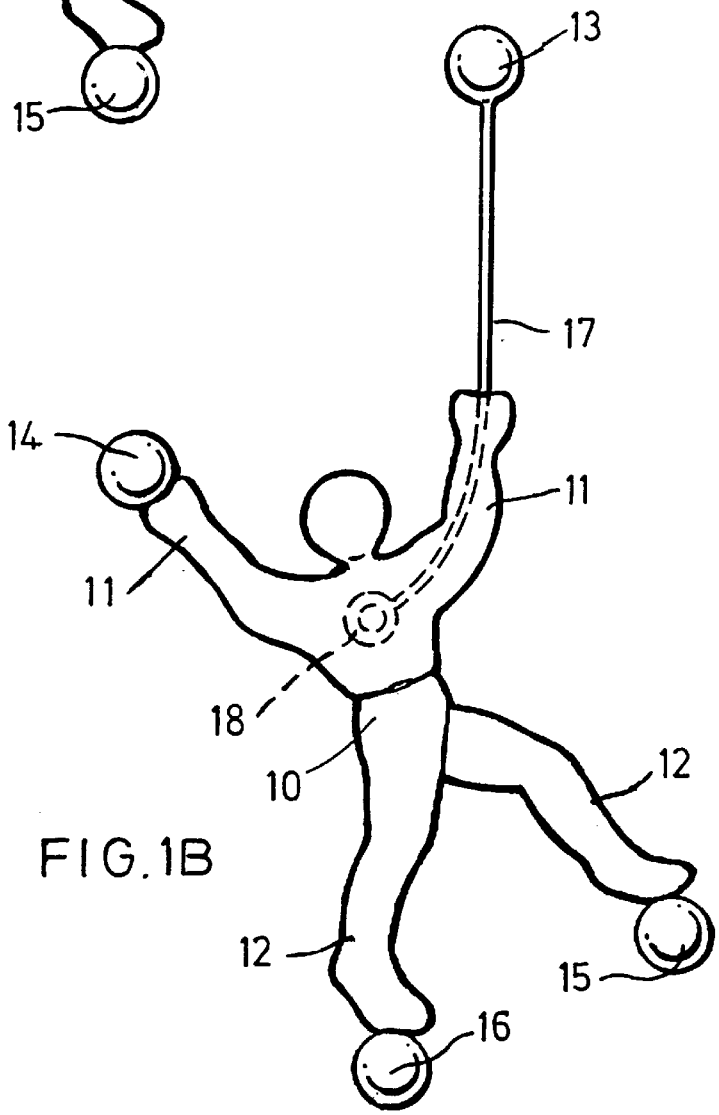

Referring to the drawings, in FIG. 1 a humanoid toy figure has a body 10 with four limbs comprising two arms 11 and two legs 12. At the remote end of each limb is provided a respective region of sticky material 13, 14, 15 and 16. The sticky region 13 is connected to the body 10 by a resilient tie 17, whereas the sticky regions 14, 15 and 16 are mounted directly to remote ends of the limbs. The tie 17 extends between the sticky region 13 and an anchor 18 provided inside the body 10. In practice, when the sticky region 13 supports the weight of the body as it moves in random fashion down a vertical surface, the tie 17 extends, as shown in FIG. 2B. After a while the sticky region will become detached, in a manner known for these kinds of tumbling toys, and the toy will tumble to be temporarily supported by one or more of the other sticky regions. As soon as the body weight is in effect removed from the sticky region 13, the tie 17 will contract and the sticky region 13 will move back to the relative position shown in FIG. 1A.

The provision of-the tie 17 for one or more limbs makes the tumbling action more varied and interesting and generally it is more convenient in practice to anchor the one end of the tie some distance inside the body. This not only provides a better movement but allows for greater practical extension of the tie 17. That is to say, the tie 17 needs to flex or extend less per unit length than if it is attached directly at one end to a remote end of a limb.

The tie 17 may be made of any suitable material and adjusted by choice of material or by altering its dimensions to match or be adjusted for various overall weights of the toy. The tie may be made of the same material as the sticky regions. The tie may be formed integrally with the region 13 and/or formed integrally with a loop in one end to fit over the anchor 18.

Figure 2A:
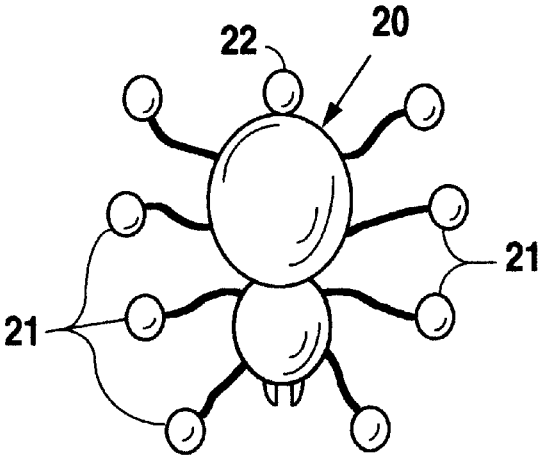
FIGS. 2A, 2B and 2C show three different configurations of a toy beetle.
Figure 2B:
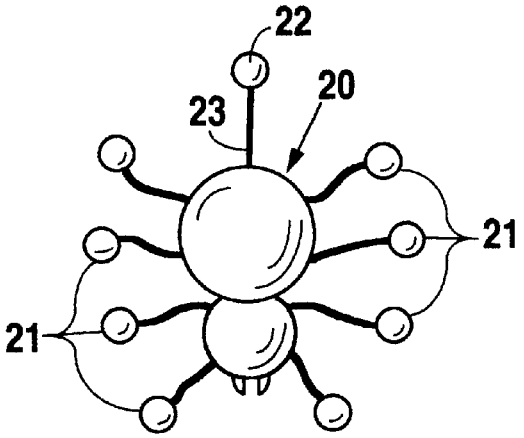
Figure 2C:
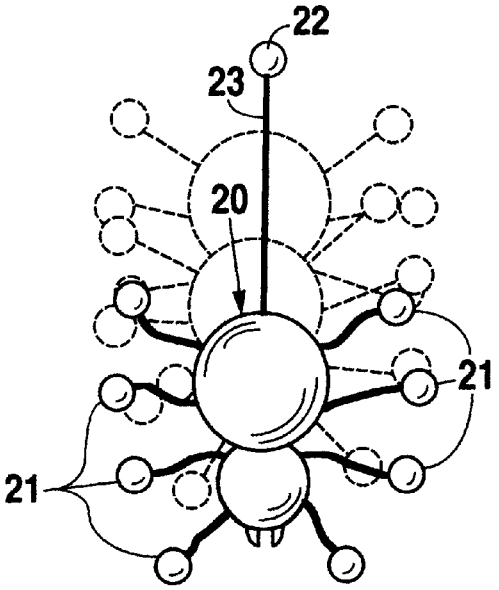

In FIGS. 2A to 2C, a toy beetle body 20 has eight limbs 21 and a tail 22. The tail 22 is attached to the beetle body 20 by a resilient tie 23 which extends to a centrally positioned anchor (not shown) inside the body 20. In FIG. 2B, the tie 23 is partially extended and in FIG. 2C the tie 23 is fully extended. The action of the tie allows the beetle body to drop vertically downwards from time to time during its tumbling action, in a manner similar to the toy of FIG. 1.

The toys may take many forms including birds, fictitious characters or animals and be provided with regions of sticky material on any appendage. Normally, the appendages comprise remote ends of limbs or a real or imaginary tail, as described, but could be ears and noses, and wings as appropriate.

It will be appreciated that the body 10 in FIG. 1 may be made in two or more parts that are hinged, pivoted or flexibly joined together.

I claim:

1. A toy which under the influence of gravity will travel down a substantially vertical surface, said toy comprising a body, appendages connected to various parts of the body, and a region of sticky material at each appendage, the adhesivity of the material being selected so that said regions of sticky material will adhere to the surface when they first contact the surface and then under the influence of gravity acting on the toy the upper of said regions or region will become detached from the surface so as to free said toy to rotate or tumble about its body to move successively down the surface, in which at least one of the regions of sticky material is attached to the body by a resilient tie that stretches whenever the weight of the toy is supported by that region of sticky material allowing that region of sticky material to extend away from said body.

2. A toy according to claim 1, in which each tie is connected at one end to a respective region of sticky material and at its other end to a central part inside a cavity in the body .

3. A toy according to claim 1, in which each tie and a respective region of sticky material is integrally formed.

* * * * *